US007572150B2

(12) United States Patent
Matsuoka

(10) Patent No.: US 7,572,150 B2
(45) Date of Patent: Aug. 11, 2009

(54) DEVICE CONNECTOR WITH MATING TERMINALS BOLTED TOGETHER

(75) Inventor: Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/178,675

(22) Filed: Jul. 24, 2008

(65) Prior Publication Data

US 2009/0029594 A1 Jan. 29, 2009

(30) Foreign Application Priority Data

Jul. 26, 2007 (JP) ..... 2007-194699

(51) Int. Cl.
*H01R 24/00* (2006.01)

(52) U.S. Cl. ..... 439/626

(58) Field of Classification Search ..... 439/626, 439/627, 628, 752, 595, 746, 752.5
See application file for complete search history.

(56) References Cited

U.S. PATENT DOCUMENTS 5,197,903 A * 3/1993 Casey et al. ..... 439/564
5,816,850 A * 10/1998 Yamada et al. ..... 439/507
6,183,314 B1 * 2/2001 Wada et al. ..... 439/752
6,568,948 B2 * 5/2003 Matsuoka ..... 439/271
6,716,069 B2 * 4/2004 Nakamura et al. ..... 439/752
6,896,560 B2 * 5/2005 Nakamura et al. ..... 439/752
7,186,135 B2 * 3/2007 Maegawa et al. ..... 439/490
7,204,726 B2 * 4/2007 Yamashita et al. ..... 439/752

FOREIGN PATENT DOCUMENTS

JP 2006-031962 2/2006

* cited by examiner

*Primary Examiner*—Chandrika Prasad
(74) *Attorney, Agent, or Firm*—Gerald E. Hespos; Anthony J. Casella

(57) ABSTRACT

A device connector to be connected with device-side terminals accommodated in a metal case (C) is provided with a first housing (10) for holding first terminals (20) connectable with the device-side terminals by bolt tightening and a second housing (50) connectable with the first housing (10) and adapted to hold second terminals (60) fixed to ends of wires (61). Connecting portions (21, 63) of the first and second terminals (20, 60) are arranged one over the other in a fitting (11) to the second housing (50) and are respectively formed with bolt insertion holes (21A, 63A). The fitting (11) is formed with an operation hole (23) used for bolt tightening operations for the connecting portions (21, 63).

13 Claims, 10 Drawing Sheets

DEVICE CONNECTOR WITH MATING TERMINALS BOLTED TOGETHER

BACKGROUND OF THE INVENTION

1. Field of the Invention

The invention relates to a device connector for supplying power to a device accommodated in a metal case.

2. Description of the Related Art

Japanese Unexamined Patent Publication No. 2006-31962 discloses a device connector for supplying power to a device such as a motor accommodated in a metal case in an electric automotive vehicle or the like. This device connector is provided with a first housing to be mounted in a mount hole that penetrates the case in inward and outward directions and a second housing to be mounted on ends of wires. The two housings are connectable with each other.

First terminals that are long and narrow in a connecting direction of the two housings are held in the first housing. Ends of the first terminals to be arranged at a side toward the device are formed with bolt holes and the first terminals are connected with device-side terminals by tightening bolts. Ends of the first terminals opposite the device-side terminals project in the connecting direction with the second housing and are connected with second terminals held in the second housing.

Each second terminal has a rectangular tube at a front end with respect to the connecting direction with the first housing. The projecting ends of the first terminals enter the rectangular tubes of the second terminals and contact resilient contact pieces in the rectangular tubes as the housings are connected for connecting the first and second terminals.

Connected parts of the first terminals and the device-side terminals are pressed strongly into contact with each other by tightening the bolts to improve connection reliability. However, such strong connection is not realized at connected parts of the first terminals and the second terminals and, hence, there is a demand for further improving connection reliability.

The invention was developed in view of the above situation and an object thereof is to improve connection reliability of a device connector.

SUMMARY OF THE INVENTION

The invention relates to a device connector to be connected with at least one device-side terminal accommodated in a case. The device connector has a first housing for holding at least one first terminal connectable with the device-side terminal by bolt tightening and a second housing that is connectable with the first housing. The second housing is adapted to hold at least one second terminal fixed to an end of a wire. The second housing is mountable on the case in such a posture that a fitting of the second housing projects out of the casing. One or more connecting portions of the first and second terminals extend substantially in a connecting direction of the two housings and are arranged one over the other in the fitting when the first and second housings are connected. The connecting portions are formed with bolt insertion holes that receive bolts to fix the connecting portions to each other. The fitting of the two housings is formed with an operation hole for a bolt tightening operation for the connecting portions.

According to such a construction, a bolt can be inserted into the fitting of the housing through the operation hole to fasten the bolt insertion holes of the first and second terminals arranged one over the other in the fitting. A strong connection is realized at a connected part of the first and second terminals in addition to the one at a connected part of the device-side terminal and the first terminal. Thus, connection reliability can be improved.

A first shielding shell fixable to the case may be mounted or mountable on a rear side of the first housing with respect to the connecting direction with the second housing, a second shielding shell may be mounted or mountable on a rear side of the second housing with respect to the connecting direction with the first housing, the first and second shielding shells may be fixable to each other while exposing the operation hole to the outside, and a shell cover for covering a part where the operation hole is exposed may be provided separately from the first and second shielding shells.

According to such a construction, the both terminals can be tightened with the bolt with the first and second shielding shells fixed. In other words, both terminals can be tightened with the bolt while the two housings are connected and relative displacements of the bolt insertion holes of the both terminals prevented. Therefore, the bolt tightening operation can be performed easily.

The case may be formed with at least one screw hole for fixing the first shielding shell with at least one screw, and the first shielding shell may be formed with at least one first screw insertion hole at a position corresponding to the screw hole of the case and fixed to the case by tightening at least one screw inserted into the first screw insertion hole into the screw hole of the case.

The second shielding shell may be formed with at least one second screw insertion hole arranged to at least partly overlap the at least one screw hole of the case and/or the first screw insertion hole. The first and second shielding shells may be fixed to the case by tightening the at least one screw inserted into the first screw insertion hole and the second screw insertion hole into the screw hole of the case. Thus, the first and second shielding shells can be fixed by one screw.

At least one of the bolt insertion holes of the first and second terminals may have a long shape in the connecting direction of the two housings. Then, the bolt insertion holes overlap even if the first and second terminals are displaced relative to each other in the fitting portion of the housings, provided that the displacement is within the length range of the bolt insertion hole. As a result, the two terminals can be tightened by the bolt.

A cap may be mountable into the operation hole and may include at least one seal ring for closely contacting the circumferential surface of the operation hole to provided sealing between the cap and the operation hole. Thus water cannot enter through the operation hole.

The cap and the fitting portion may include at least one engaging piece and at least one engaging projection engageable with each other to hold the cap mounted into the operation hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
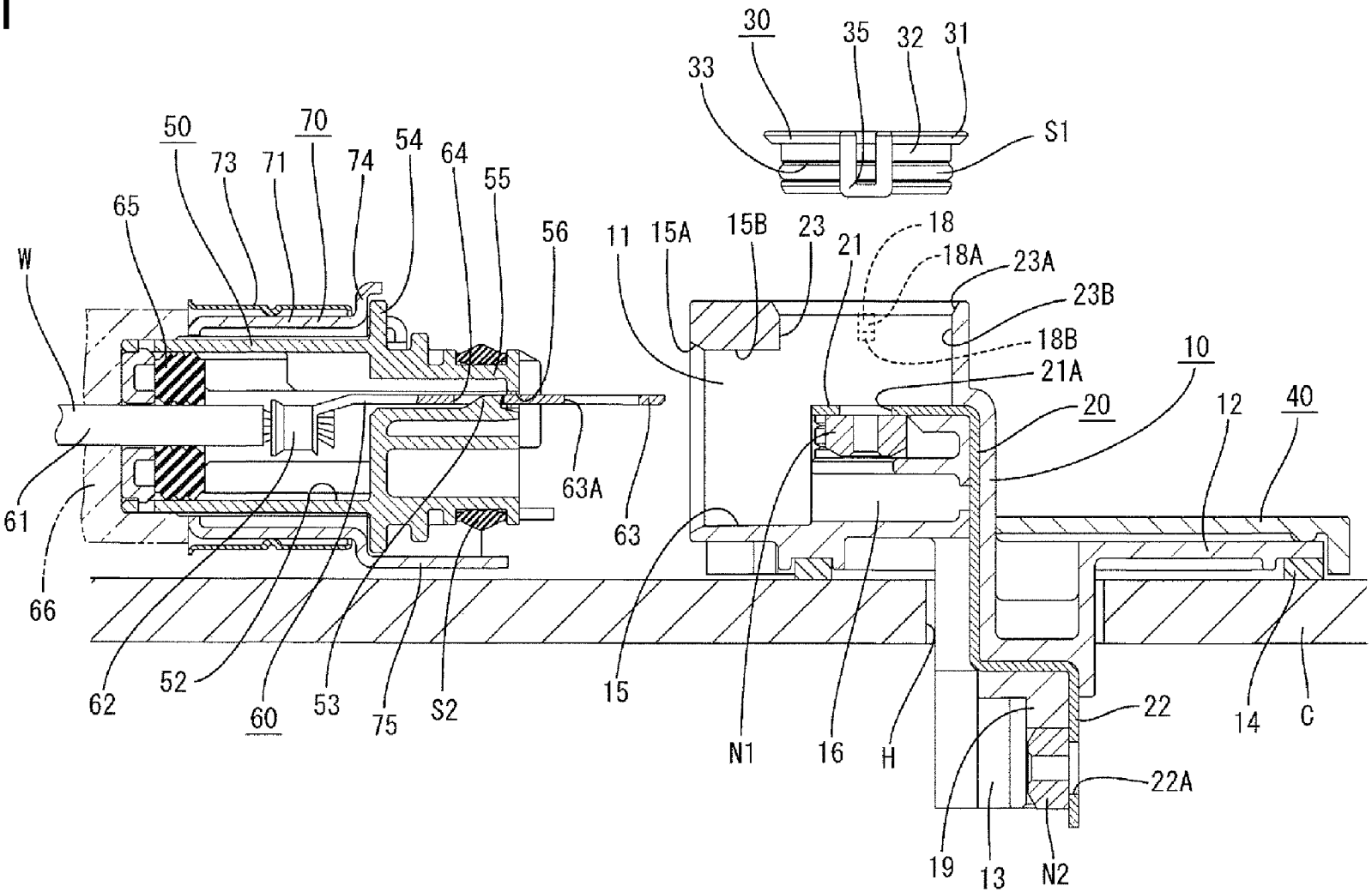
FIG. 1 is a side view in section showing a state before two housings are connected in one embodiment.

A device connector according to the invention is described with reference to FIGS. 1 to 10. The device connector is used for supplying power to an unillustrated device (e.g. a motor, an inverter or the like installed in a hybrid vehicle or the like) and has first and second housings 10 and 50 that are connectable with and separable from each other. In the following description, ends of the two housings 10, 50 to be connected are referred to as front ends, and reference is made to FIG. 1 concerning upper and lower sides. The device is to be accommodated in a conductive metal case C having a shielding function. The case C has a mount hole H that penetrates the case C substantially in inward and outward directions.

The first housing 10 is made e.g. of synthetic resin and includes a first fitting 11 in the form of a wide oblong parallelepiped. Flanges 12 extend back from opposite sides of the bottom end of the first fitting 11 and a device-side fitting 13 projects out and down from the lower surface of the flange 12. The device-side fitting 13 is at a position behind adjacent to the first fitting 11.

The first housing 10 is to be mounted into the mount hole H of the case C in a posture so that the first fitting 11 projects out of the case C and the device-side fitting 13 is accommodated in the case C. At this time, the flange 12 extends substantially along an outer surface of the case C.

The first fitting 11 has a substantially box shape with a hollow inside, and a connection opening 15 is formed in the front thereof. The connection opening 15 has a wide substantially oblong shape and extends substantially in forward and backward directions. A slanted connection surface 15A is formed around the periphery of the connection opening 15 and is inclined to increase an opening size toward the front. A flat connection sealing surface 15B is formed part in the connection opening 15 behind the slanted connection surface 15A and defines a uniform opening shape in forward and backward directions.

Three wire-side placing tables 16 are formed substantially side by side in the lateral direction in the first fitting 11, and nuts N1 are accommodated in the respective wire-side placing tables 16. Vertically aligned nuts N1 are placed so that their upper surfaces are substantially flush with the upper surfaces of the wire-side placing tables 16.

Engaging projections 18 are provided on the opposite sides of the first fitting 11 and project sideways from the side surfaces of the first fitting 11. Riding surfaces 18A are defined along the tops of the engaging projections 18. Engaging surfaces 18B are defined along the bottoms of the engaging projections 18 and are aligned substantially perpendicular to the side surfaces of the first fitting 11.

Three device-side placing tables 19 are formed substantially side by side in lateral direction in the device-side fitting 13. Three device-side placing tabs 19 are arranged at positions more distant from the flange 12 from one side towards the other side of an arranging direction thereof. The middle placing table 19 is displaced back from those at the opposite ends. Nuts N2 are accommodated in the respective device-side placing tables 19. The nuts N2 are placed so that the axial lines thereof extend substantially vertically and the rear surfaces thereof are substantially flush with those of the device-side placing tables 19.

Three, first terminals 20 are held in the first housing 10 and are bent to extend from the respective wire-side placing tables 16 to the corresponding device-side placing tables 19. Each first terminal 20 includes a first connecting portion 21 that extends substantially forward along the upper surface of the wire-side placing table 16 and a device-side connecting portion 22 that extends substantially along the rear surface of the device-side placing table 19. The first terminals 20 are insert molded into the first housing 10 so that a unitary matrix of resin surrounds and supports a portion of each first terminal 20.

The first connecting portion 21 of each first terminal 20 has a first bolt insertion hole 21A substantially coaxial with the nut N1 placed on the corresponding wire-side placing table 16. The device-side connecting portion 22 of each first terminal 20 has a device-side bolt insertion hole 22A substantially coaxial with the nut N2 placed on the corresponding device-side placing table 19. The bolt insertion holes 21A, 22A are round and slightly larger than shaft holes of the nuts N1, N2.

An unillustrated device-side terminal connected with the device is placed on the rear of the device-side connecting portion 22 placed on the device-side placing table 19. The device-side connecting portion 22 and the device-side terminal are connected electrically by screwing an unillustrated bolt inserted through a bolt hole of the device-side terminal and the device-side bolt insertion hole 22A of the device-side connecting portion 22 into the nut N2.

Figure 2:
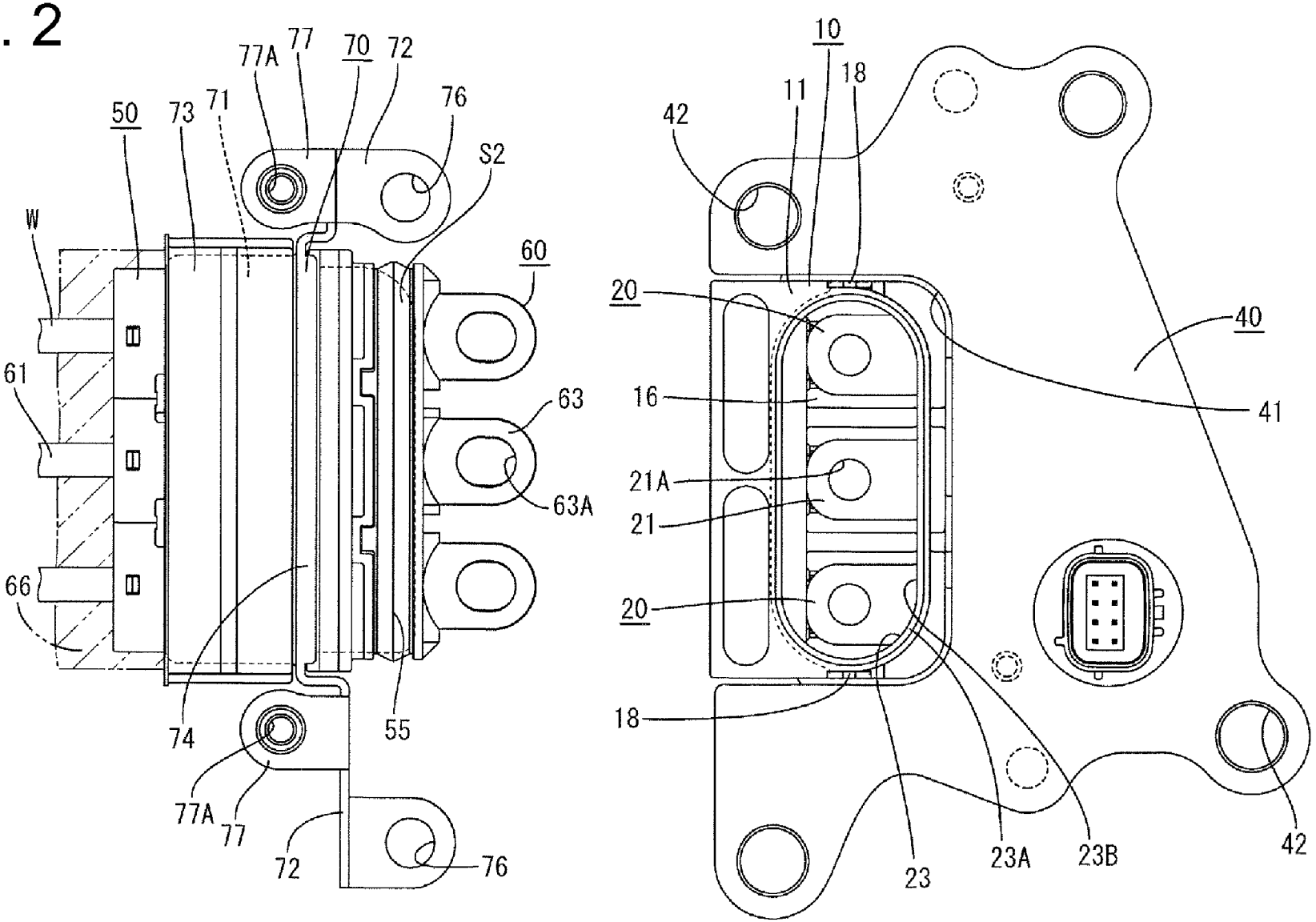
FIG. 2 is a plan view showing the state of FIG. 1.
Figure 3:
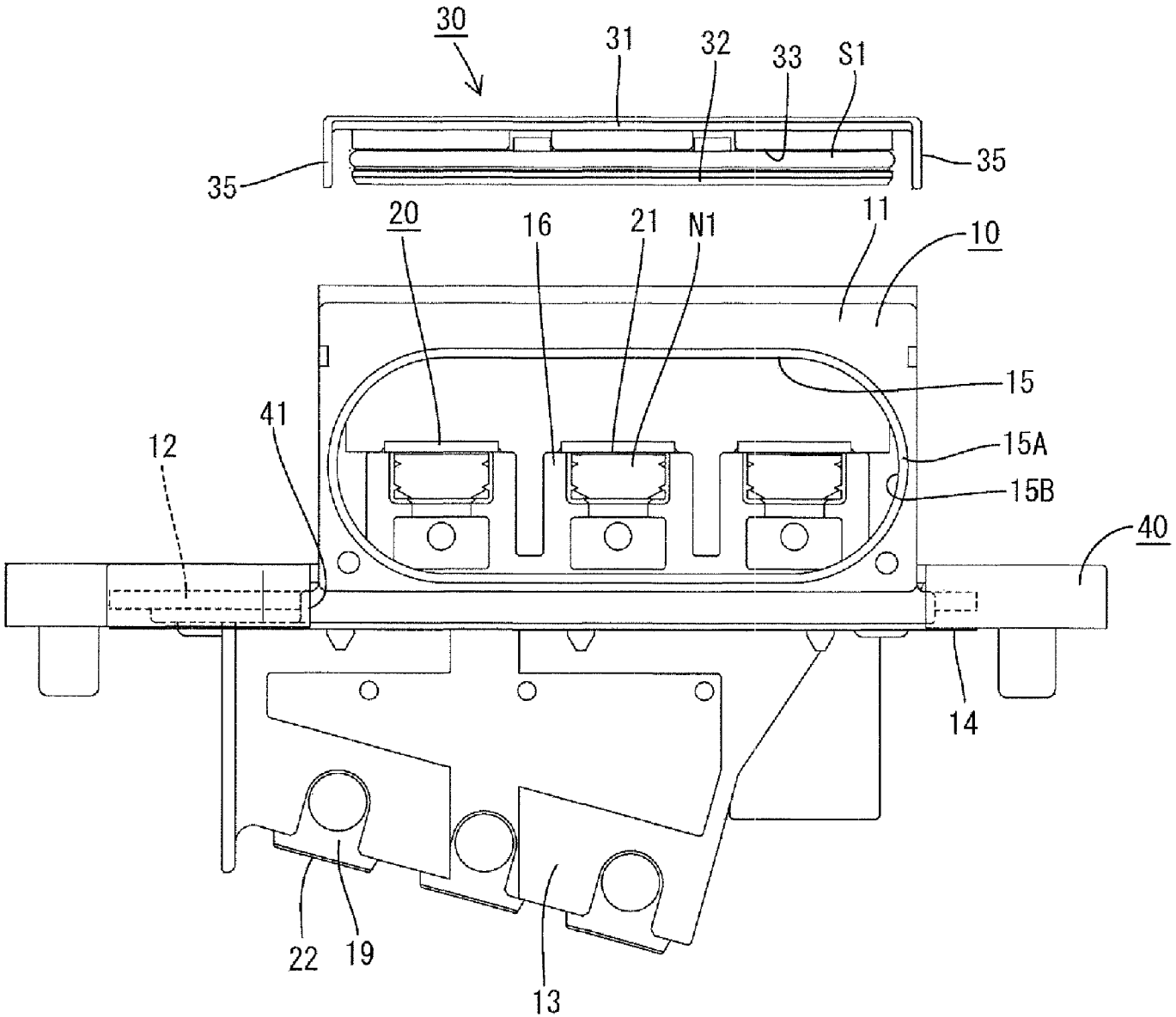
FIG. 3 is a front view of the first housing mounted with a first shielding shell.

An operation hole 23 vertically penetrates part of the upper wall of the first fitting 11 right above the wire-side placing tables 16. The three wire-side placing tables 16 are exposed outwardly or upwardly of the first fitting 11 through this operation hole 23. As shown in FIG. 2, the operation hole 23 has a wide substantially oblong shape, and the longer side dimension thereof is the sum of a distance between the opposite ends of the first connecting portions 21 of the first terminals 20 and specified dimensions at the opposite sides and the shorter side dimension thereof is the sum of the diameter of the nut N1 and specified dimensions at the front and rear sides of the nut N1.

A slanted surface 23A is formed around the upper peripheral edge of the operation hole 23 and is inclined to increase an opening size toward the upper side. A flat sealing surface 23B is formed around the periphery of the operation hole 23 below the slanted surface 23A and has the substantially same opening shape in the vertical direction.

The first housing 10 includes a cap 30 for closing the operation hole 23. The cap 30 includes a wide substantially oblong lid 31 slightly larger than the operation hole 23. A closing portion 32 projects down from the lower surface of the lid portion 31 and has substantially the same outer shape as the sealing surface 23B of the operation hole 23. A mounting groove 33 is formed in the outer peripheral surface of the closing portion 32 over substantially the entire periphery, and a seal ring S1 is mounted in the mounting groove 33. The seal ring S1 closely contacts the sealing surface 23B when the cap 30 is mounted into the operation hole 23 and provides sealing between the operation hole 23 and the cap 30. Thus, water cannot enter the first fitting 11 through the operation hole 23.

The cap 30 has engaging pieces 35 that engage the engaging projections 18 of the first fitting portion 11. The engaging pieces 35 are cantilevered down at the opposite ends of the lid 31 and are resiliently deformable in directions facing each other.

A first shielding shell 40 is mounted on the flange 12 at the rear side of the first housing 10 with respect to a connecting direction with the second housing 50. The first shielding shell 40 is aluminum die-cast and has a substantially rectangular escaping portion 41 cut along the outer shape of the first fitting 11 and shaped to cover the upper and peripheral surfaces of the flange 12.

First screw insertion holes 42 are formed near four corners of the first shielding shell 40 and at positions corresponding to screw holes (not shown) of the case C. The first shielding shell 40 is fixed electrically to the case C by aligning the first screw insertion holes 42 with the screw holes of the case C. Screws then are inserted through the respective holes and tightened. Thus, the flange 12 of the first housing 10 is sandwiched between the outer surface of the case C and the first shielding shell 40 and a seal 14 mounted on the lower surface of the flange 12 is held in close contact with the outer surface of the case C to seal between the peripheral edge of the mount hole H of the case C and the first housing 10.

The second housing 50 is made e.g. of synthetic resin, and three cavities 52 are formed side by side in the lateral direction. Second terminals 60 fixed to ends of respective wires 61 are inserted into the respective cavities 52 from behind. A locking lance 53 is provided near the front end of each cavities 52 for engaging and retaining the corresponding second terminal 60.

A front stop wall 54 projects around the outer periphery of the second housing 50 at a position slightly before the center of the second housing 50 in forward and backward directions.

A second fitting 55 is defined on the second housing 50 before the front stop wall 54 and is configured to fit in the first fitting 11 of the first housing 10. A seal ring S2 is mounted on the outer peripheral surface of the second fitting 55. The seal ring S2 closely contacts the connection sealing surface 15B when the second fitting 55 is fit into the first fitting 11 to provide sealing therebetween and to prevent water from entering into the first fitting 11 through the connection opening 15.

The second terminals 60 are oblongs that are long in forward and backward directions. Crimping portions 62 are formed at the rear ends of the second terminals 60 and are configured for crimped connection with the ends of the three wires 61 forming a wiring harness W. Second connecting portions 63 are defined at the front ends of the second terminals 60 and extend forward from terminal insertion holes 56 in the front wall of the second fitting portion 55 when the second terminals 60 are accommodated in the respective cavities 52. The second connecting portions 63 are placed on the upper surfaces of the first connecting portions 21 of the first terminals 20 when the first and second housings 10, 50 are connected. Each second connecting portion 63 has a second bolt insertion hole 63A to be placed above the first bolt insertion hole 21A. The second bolt insertion hole 63A is slightly larger than the first bolt insertion hole 21A and has an oblong shape longer in forward and backward directions (see FIG. 2). Each second terminal 60 has an engaging hole 64 that engages the locking lance 53 of the corresponding cavity 52. Further, a rubber plug 65 fit on the wire 61 seals between the wire 61 and the cavity 52.

The second shielding shell 70 is die-cast unitarily from aluminum to define a wide oblong tubular main portion 71 and mounting portions 72 that extend from the main portion 71. The main portion 71 is fit on a rear part of the second housing 50. A shield 66, such a braided wire or a conductive film, collectively surrounds the three wires 61, and an end of the shield 66 is fit on the outer peripheral surface of the main portion 71. The shield 66 is fixed electrically to the main portion 71 by a crimp ring 73. The shield 66 and the wires W form part of the wiring harness W.

A bulge 74 bulges out near the front end of the main portion 71 of the second shielding shell 70. The bulge 74 has a wide rectangular outer shape slightly larger than the main portion 71, and the upper end thereof is bent to extend slightly forward. A lower plate 75 projects forward from the lower edge of the bulge 74 and has a wide substantially rectangular shape that covers a front portion of the second housing 50 from below.

Figure 4:
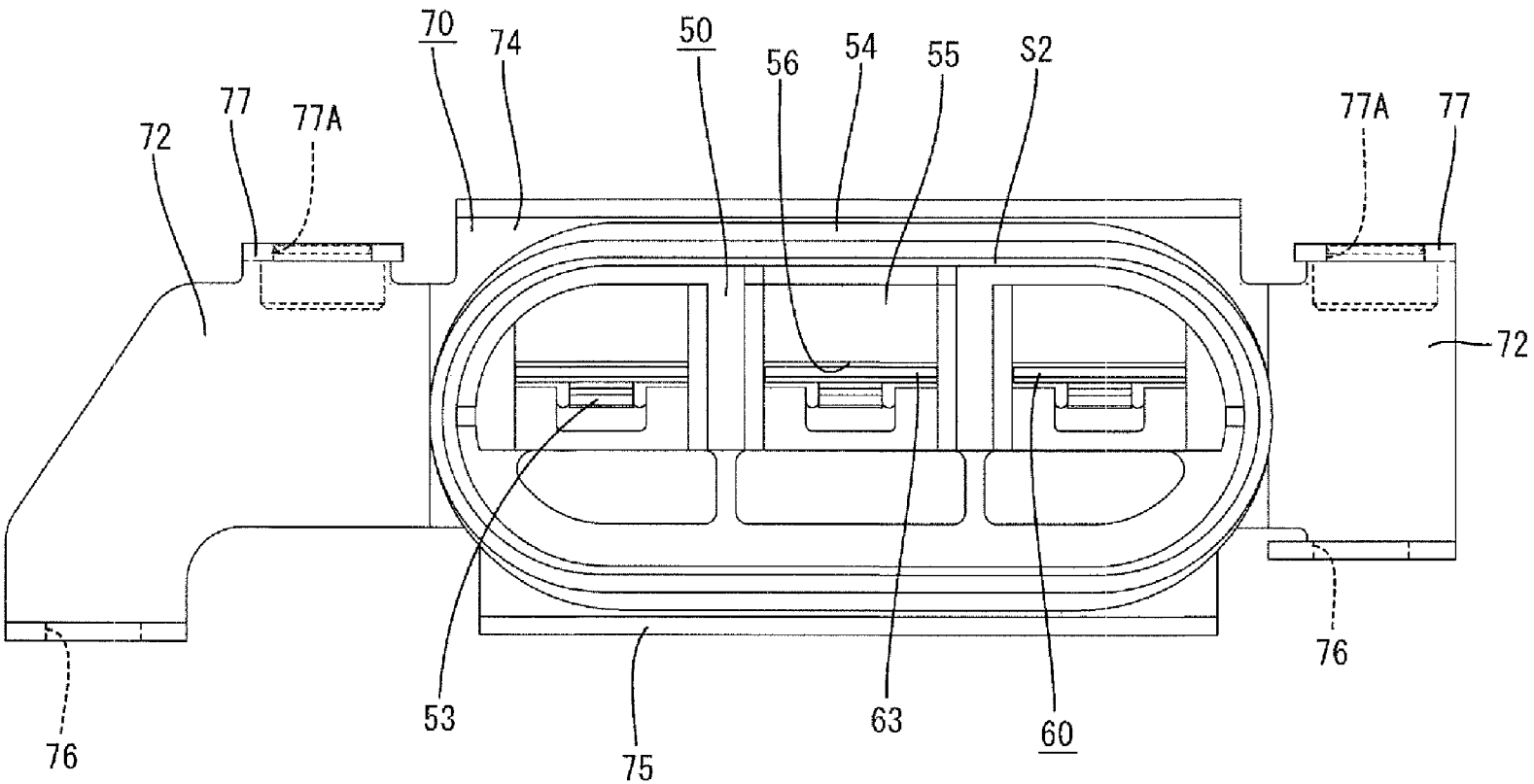
FIG. 4 is a front view of the second housing mounted with a second shielding shell.
Figure 5:
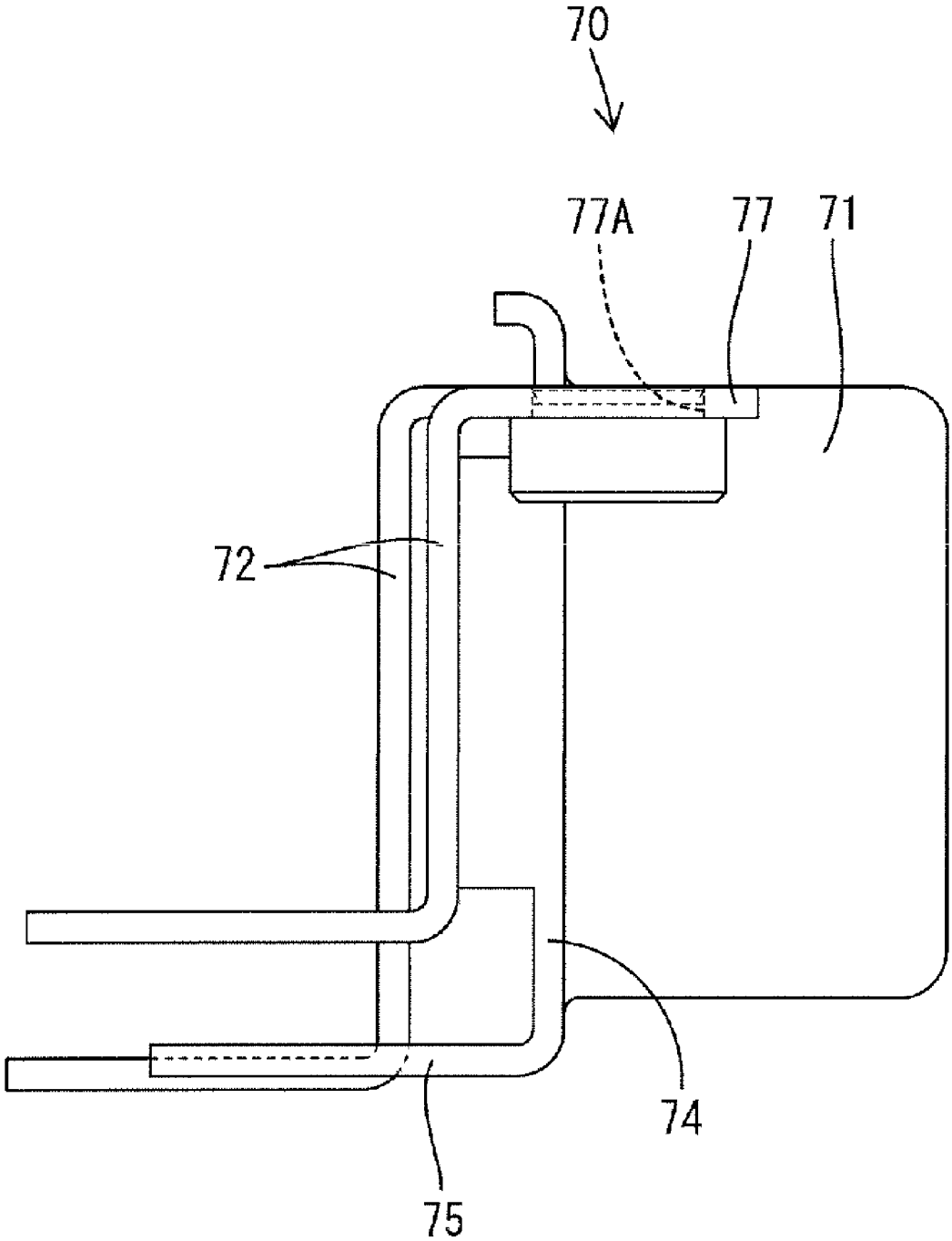
FIG. 5 is a side view of the second shielding shell.
Figure 6:
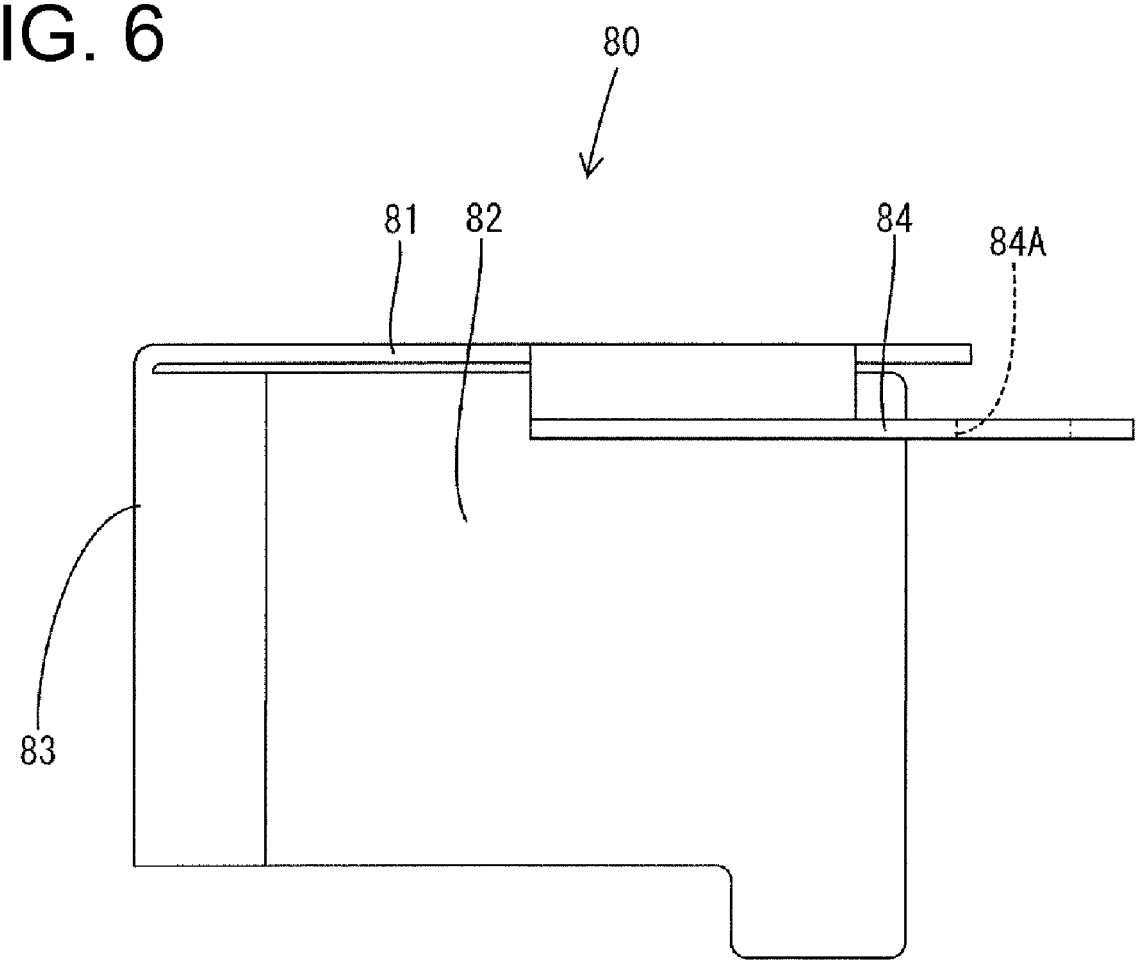
FIG. 6 is a side view of a shell cover.
Figure 7:
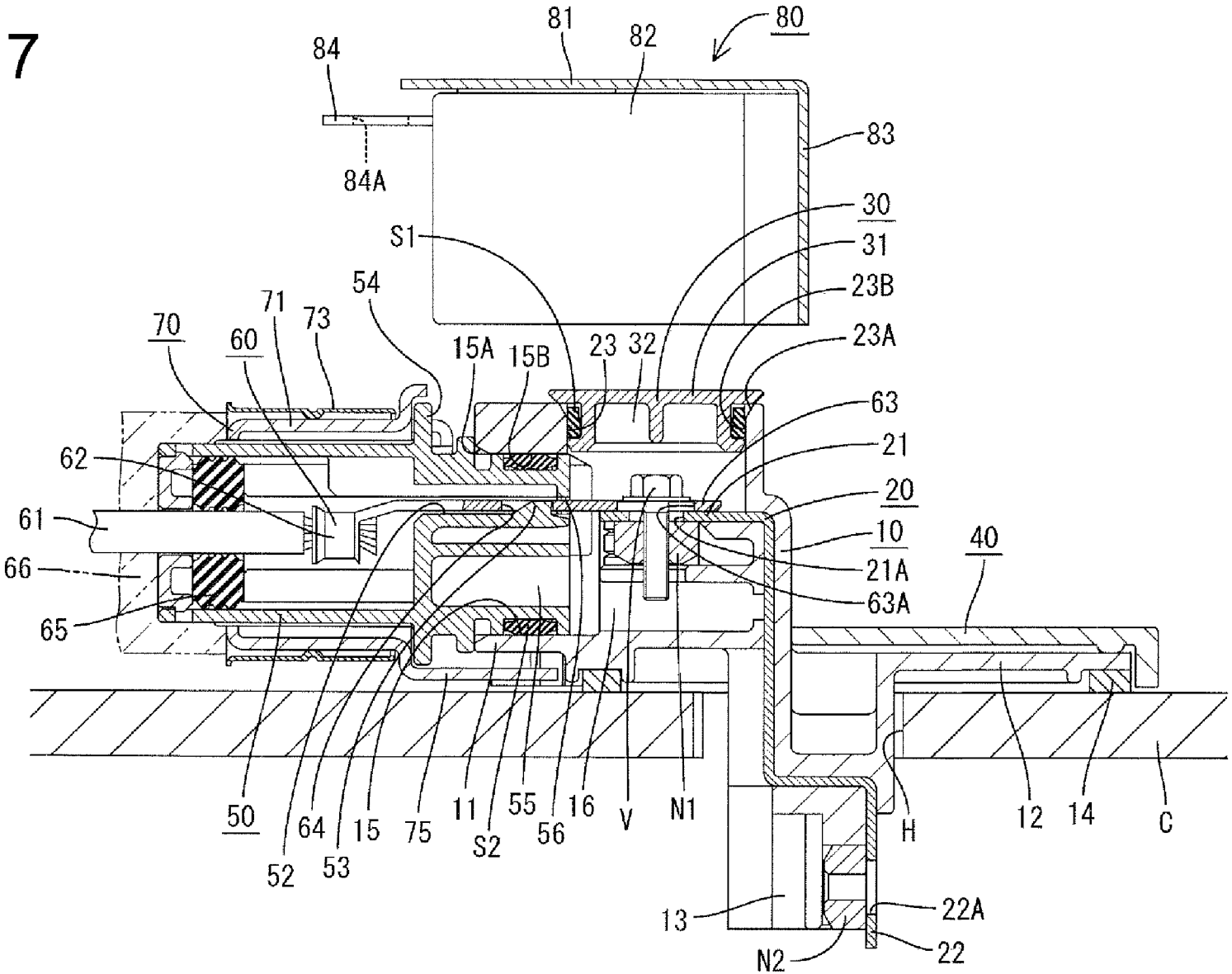
FIG. 7 is a side view in section showing a state where the shell cover is mounted.

Main portions 72 project out sideways at positions slightly before the bulge 74 and have bottom ends bent forward. These bent portions have second screw insertion holes 76 at positions overlapping the screw holes of the case C and the first screw insertion holes 42 of the first shielding shell 40. Thus, the first and second shielding shells 40 and 70 can be fixed electrically to the case C by screwing screws inserted through the first screw insertion holes 42 and the second screw insertion holes 76 into the screw holes of the case C. The second screw insertion hole 76 on the left side of FIG. 4 is arranged substantially at the same height as the lower plate 75, and the second screw insertion hole 76 on the right side of FIG. 4 is located above the lower plate 75 by a distance substantially equal to the thickness of the first shielding shell 40.

Cover mountable portions 77 project sideways from the upper edges of both main portions 72 of the second shielding shell 70. The cover mountable portions 77 are formed with cover screw holes 77A.

The first fitting 11 is covered by the first and second shielding shells 40, 70 except its rear, upper and opposite sides when the first and second housings 10, 50 are connected and the first and second shielding shells 40, 70 are fixed. Thus, the rear, upper and opposite side surfaces of the first fitting 11 are exposed to the outside, including the operation hole 23 (see FIGS. 7 and 8).

These exposed parts are covered by a shell cover 80 that is separate from the first and second shielding shells 40, 70. The shell cover 80 is die-cast aluminum and includes an upper plate 81 for covering the upper surface of the first fitting 11, side plates 82 for covering the opposite side surfaces of the first fitting 11 and a rear plate 83 for covering the rear surface of the first fitting 11. The upper plate 81 is substantially rectangular and slightly larger than the escaping portion 41 of the first shielding shell 40.

Figure 8:
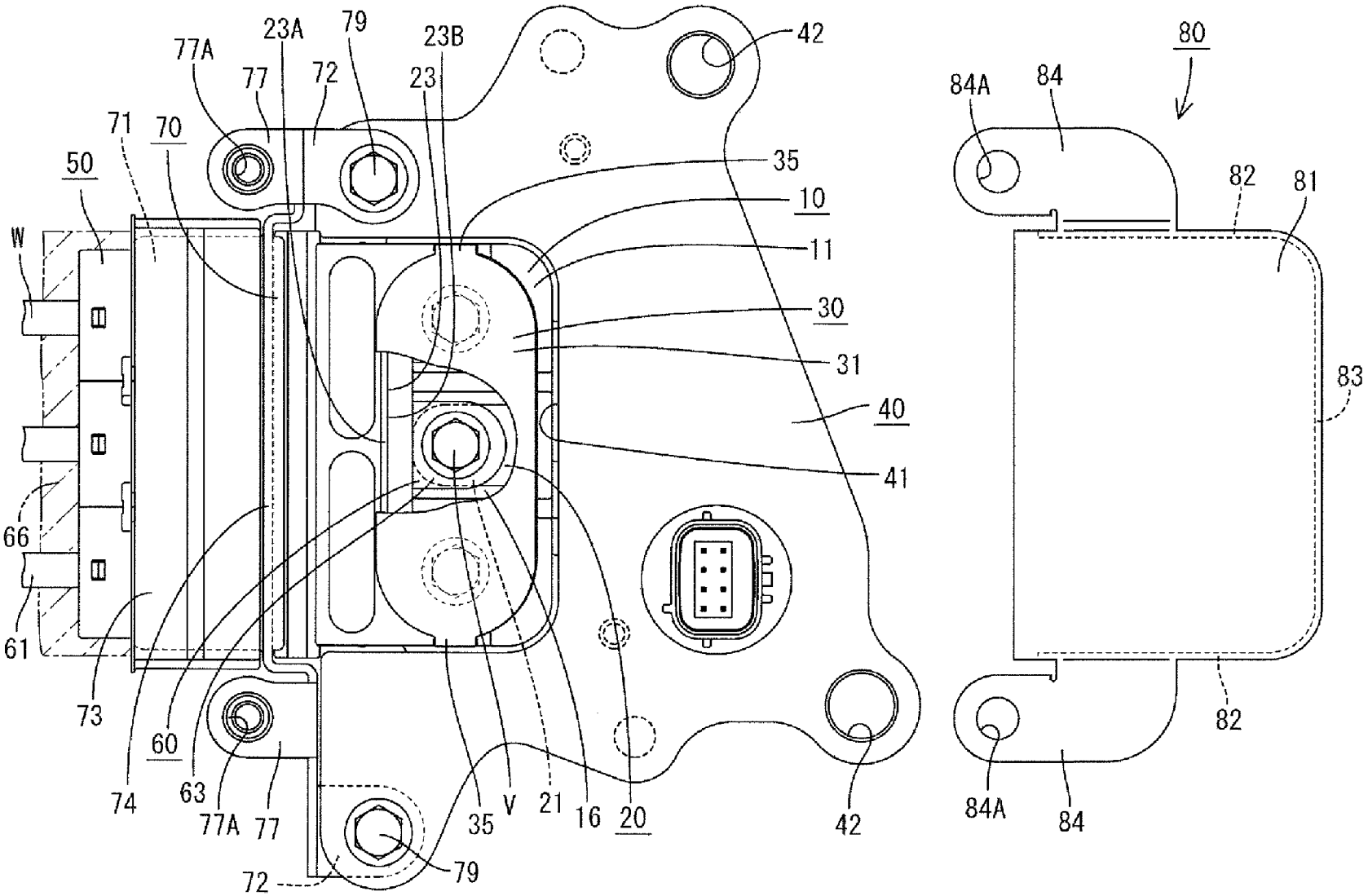
FIG. 8 is a plan view showing the state of FIG. 7.
Figure 9:
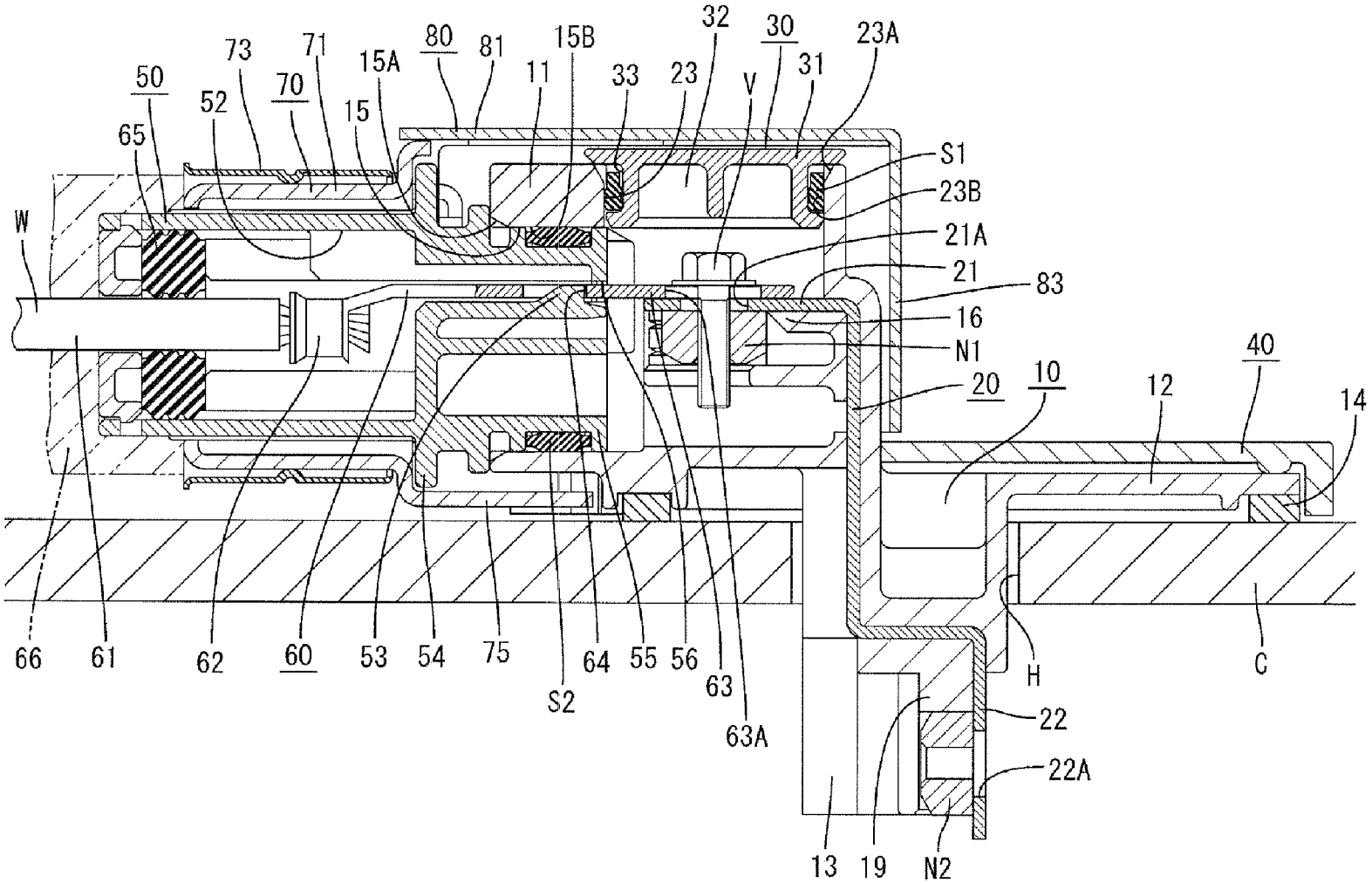
FIG. 9 is a side view in section showing a state where the shell cover is mounted.
Figure 10:
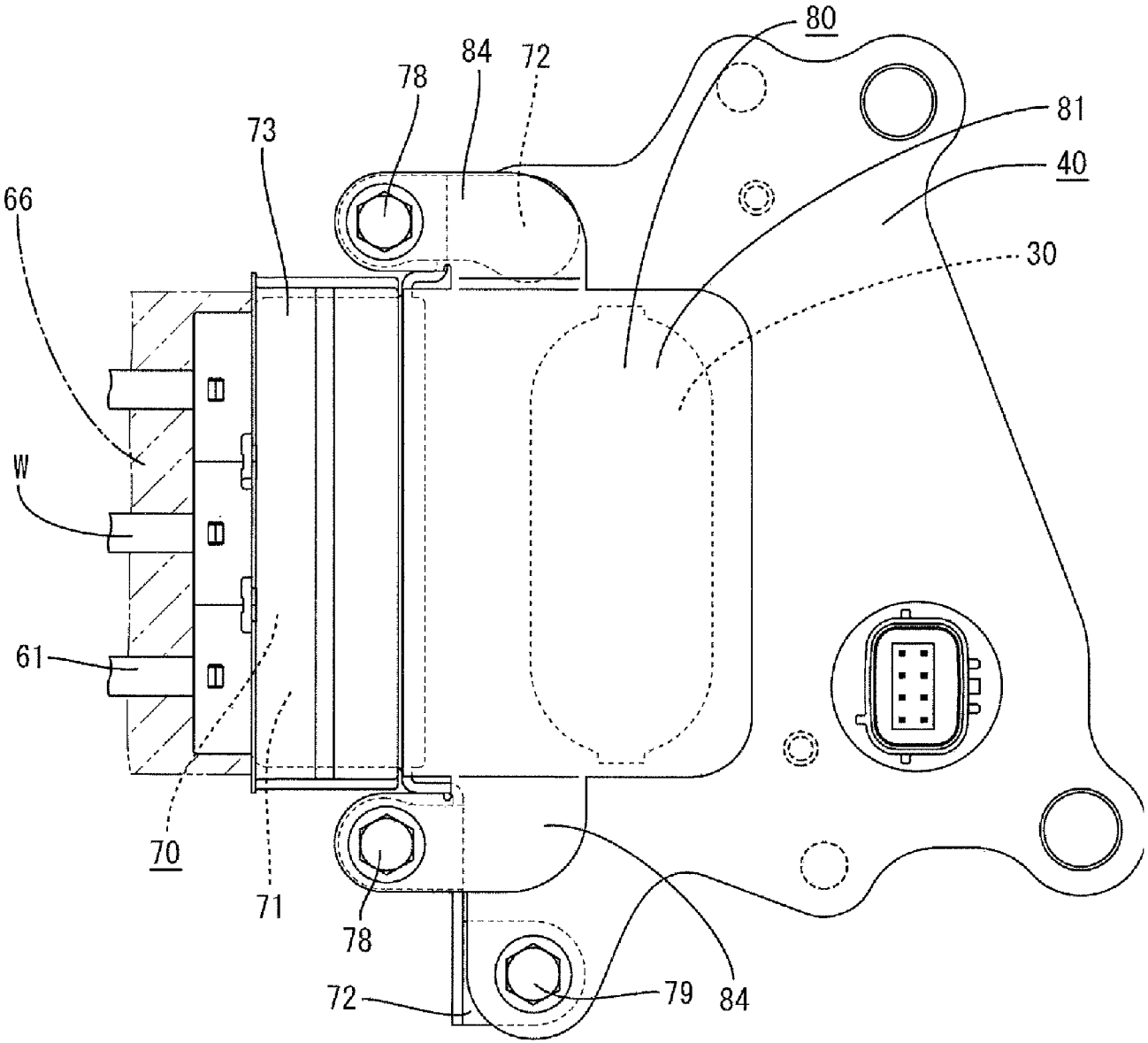
FIG. 10 is a plan view showing the state of FIG. 9.

Cover mounting portions 84 project sideways from the lateral edges of the upper plate 81 of the shell cover 80 (see FIG. 8). The cover mounting portions 84 are placed on the upper surfaces of the cover mountable portions 77 of the second shielding shell 70 when the shell cover 80 is mounted to cover the exposed parts,. Cover fixing holes 84A are formed in the cover mounting portions 84 at positions to overlap the cover screw holes 77A of the cover mountable portions 77. The shell cover 80 is fixed electrically to the second shielding shell 70 by screwing screws 78 inserted through the cover fixing holes 84A into the cover screw holes 77A.

The second fitting 55 of the second housing 50 is fit into the connection opening 15 of the first fitting 11. Then, the second connecting portions 63 of the second terminals 60 reach positions above the first connecting portions 21 of the first terminals 20 at the back side of the first fitting 11 and the second bolt insertion holes 63A are placed above the first bolt insertion holes 21A (see FIG. 7). Further, the second screw insertion holes 76 of the second shielding shell 70 reach the screw holes of the case C and the first screw insertion holes 42 of the first shielding shell 40 that already are arranged to overlap (see FIG. 8). The upper second screw insertion hole 76 in FIG. 4 is above the first screw insertion hole 42. However, the lower second screw insertion hole 76 in FIG. 4 is between the first screw insertion hole 42 and the case C. Screws 79 are inserted through the overlapping first and second screw insertion holes 42, 76 and screwed into the screw holes of the case C to fix the first and second shielding shells 40, 70 electrically to the case C. The two first screw insertion holes 42 at the rear (right in FIG. 8) are fixed only to the case C.

The first and second shielding shells 40, 70 are fixed at two positions by tightening the screws at a total of two positions. This contrasts with arrangements where each of first and second shielding shells is fixed to a case at two different positions, and hence requiring a total of four screw tightening operations have to be performed at a total of four positions. Therefore, the number of screws and the number of screw tightening operations can be reduced with the subject invention.

Bolts V are inserted through the operation hole 23, through the first and second bolt insertion holes 21A and 63A and into the respective nuts N1 in the wire-side placing tables 16 after the first and second housings 10, 50 are connected and the first and second shielding shells 40, 70 are fixed to the case C by the screws. Thus, the first and second terminals 20, 60 are pressed strongly against each other to be electrically connected. Hence, connection reliability is improved since strong connection by bolt tightening is realized at the connected parts of the first and second terminals 20, 40 in addition to the connection at the connected parts of the device-side terminals and the first terminals 20.

The fixed first and second shielding shells 40, 70 prevent the connected first and second housings 10 and 50 from being displaced away from one another. Thus, the first and second bolt insertion holes 21A and 63A remain aligned and the bolts V can be inserted into the bolt insertion holes 21A, 63A without holding the first and second terminals 20, 40 by hand to prevent displacement of the bolt insertion holes 21A, 63A. Hence, the bolt tightening operation is more efficient.

The second bolt insertion holes 63A are slightly larger than the first bolt insertion holes 21A and have an oblong shape longer in forward and backward directions. Therefore, the bolt insertion holes 21A, 63A will remain sufficiently overlapped for an efficient connecting operation even if the first and second connecting portions 21, 63 are displaced from each other, provided such displacements are within the size of the second bolt insertion holes 63A. Therefore, the terminals 20, 60 can be bolted reliably. The second bolt insertion holes 63A need not be as wide as they are long in the connecting direction of the housings 10, 50 because the terminals 20, 60 more likely to displace in the connecting direction.

The operation hole 23 is sufficiently large for a tool, such as an impact wrench, to be inserted easily into the operation hole 23 for tightening the bolts V. Therefore the bolt tightening operations can be performed easily.

The cap 30 is mounted into the operation hole 23 when the bolt tightening operations for the terminals 20, 60 are completed. More particularly, the closing portion 32 of the cap 30 is fit into the operation hole 23. Thus, the engaging pieces 35 move onto the riding surfaces 18A of the engaging projections 18 and resiliently deform outward. The lid 31 is on the upper surface of the first fitting 11 when the closing portion 32 of the cap 30 is fit completely into the operation hole 23. Simultaneously, the engaging pieces 35 move over the engaging projections 18 and resiliently restore to engage the engaging surfaces 18B of the engaging projections 18 for holding the cap 30. The cap 30 can be mounted easily by a one-touch operation.

The shell cover 80 then is mounted from above the first fitting 11 and fixed to the second shielding shell 70 with the screws. Thus, the first and second housings 10, 50 are shielded while being covered by the first and second shielding shells 40, 70 and the shell cover 80 (see FIGS. 9 and 10).

As described above, the bolt insertion holes 21A, 63A of the first and second terminals 20, 60 are arranged one above the other in the first fitting 11 and are fastened with the bolts. Thus, strong reliable connection is realized at the connected parts of the first and second terminals 20, 60 in addition to the connection at the connected parts of the device-side terminals and the first terminals 20.

The invention is not limited to the above described and illustrated embodiment. For example, the following embodiments are also embraced by the technical scope of the present invention as defined by the claims.

The shell cover 80 is separate from the first and second shielding shells 40, 70 in the above embodiment. However, a shell cover may be formed integral to the second shielding shell in such a state as to be displaceable between a position for covering the operating hole and a position for exposing the operation hole.

Although the second fitting 55 is fittable into the first fitting 11 in the above embodiment, the second fitting may include a receptacle that can fit onto the first fitting. At this time, if the first and second fittings overlap, an operation hole penetrating both may be formed.

The second bolt insertion holes 63A are slightly larger than the first bolt insertion holes 21A and have a substantially oblong shape slightly longer in forward and backward directions in the above embodiment. However, the second bolt insertion holes may have the same size as the first bolt insertion holes. Alternatively, the first bolt insertion holes may be larger than the second bolt insertion holes.

Although the cap 30 is provided to close the operation hole 23 in the above embodiment, it may not necessarily be provided.

Although the cap 30 includes the seal ring S1 in the above embodiment, the seal ring may not necessarily be provided.

The cap 30 includes the engaging pieces 35 and the first fitting portion 11 includes the engaging projections 18 in the illustrated embodiment. However, the engagement of the cap and the first fitting portion does not matter.

What is claimed is:

1. A device connector to be connected with at least one device-side terminal accommodated in a case, comprising:

a first housing for holding at least one first terminal connectable with the device-side terminal by bolt tightening, and a second housing connectable with the first housing and adapted to hold at least one second terminal fixed to an end of a wire, wherein:

the first housing is mountable on the case in a posture so that a fitting to the second housing projects outwardly of the case, at least one connecting portion of the first and second terminals extends substantially in a connecting direction of the housings are arranged one over the other in the fitting when the first and second housings are connected, and are formed respectively with bolt insertion holes, through which bolts are insertable to fix the connecting portions to each other, and the fitting portion of the housings is formed with an operation hole for a bolt tightening operation for the connecting portions.

2. The device connector of claim 1, wherein a first shielding shell fixable to the case is mountable on a rear side of the first housing with respect to the connecting direction with the second housing, a second shielding shell is mountable on a rear side of the second housing with respect to the connecting direction with the first housing, the first and second shielding shells are fixable to each other while exposing the operation hole to the outside, and a shell cover provided separately from the first and second shielding shells for covering a part where the operation hole is exposed.

3. The device connector of claim 2, wherein the case is formed with at least one screw hole for fixing the first shielding shell with at least one screw, and the first shielding shell is formed with at least one first screw insertion hole at a position corresponding to the screw hole of the case and fixed to the case by tightening the screw inserted into the first screw insertion hole into the screw holes of the case.

4. The device connector claim 3, wherein the second shielding shell has at least one second screw insertion hole registered with the screw hole of the case and the first screw insertion hole, the first and second shielding shells being fixed to the case by tightening the screws inserted into the first and second screw insertion holes into the screw holes of the case.

5. The device connector of claim 1, wherein at least one of the bolt insertion hole of the first and second terminals has a long shape in the connecting direction of the two housings.

6. The device connector of claim 1, wherein a cap is mountable into the operation hole and includes at least one seal ring for sealing between the cap and the operation hole by closely contacting circumferential surfaces of the operation hole.

7. The device connector of claim 6, wherein the cap and the fitting include at least one engaging piece and at least one engaging projection engageable with each other to hold the cap mounted when the cap is mounted into the operation hole.

8. A device connector to be mounted to a case having opposite inner and outer surfaces and a hole penetrating through the case from the outer surface to the inner surface, the device connector comprising:

a first housing having a connection opening exteriorly of the case and extending substantially parallel to the outer surface of the casing, an operation hole formed into the first housing substantially orthogonal to the outer surface of the case and communicating with the connection opening, the first housing further having a device-side fitting extending through the hole and beyond the inner surface of the case;

a first terminal with a first connecting portion in the connection opening, a first bolt insertion hole extending through the first connection portion substantially orthogonal to the outer surface of the case and aligned with the operation hole, the first terminal further having a device-side connecting portion in the device-side fitting;

a second housing insertable into the connection opening of the first housing; and a second terminal in the second housing and having a second connecting portion with a second bolt insertion hole aligned with the first bolt insertion hole and with the operation hole.

9. The device connector of claim 8, further comprising a first shielding shell fixed to the case and covering at least part of the first housing, a second shielding shell covering at least part of the second housing, the first and second shielding shells being fixable to each other while exposing the operation hole, and a shell cover formed separately from the first and second shielding shells and covering the operation hole.

10. The device connector of claim 9, wherein the case is formed with at least one screw hole for receiving at least one screw, the first shielding shell being formed with at least one first screw insertion hole registered with the screw hole of the case and the second shielding shell being formed with at least one second screw insertion hole registered with the first screw insertion hole, the first and second shielding shells being fixed to the case by tightening screws inserted through the first and second screw insertion holes and into the screw holes of the case.

11. The device connector of claim 10, wherein at least one of the bolt insertion hole of the first and second terminals has a long shape in a connecting direction of the housings.

12. The device connector of claim 11, further comprising a cap mounted into the operation hole, the cap having a seal ring for sealing between the cap and the operation hole.

13. The device connector of claim 12, wherein the cap and the first housing include at least one engaging piece and at least one engaging projection engageable with each other to hold the cap in the operation hole.

* * * * *